US012624616B1

(12) United States Patent
Schneider et al.

(10) Patent No.: US 12,624,616 B1
(45) Date of Patent: May 12, 2026

(54) STAB AND HINGE OVER SYSTEM AND METHODS OF USE THEREOF

(71) Applicant: OneSubsea IP UK Limited, London (GB)

(72) Inventors: Nils Schneider, Celle (DE); Christoph Thiele, Celle (DE)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 19/252,936

(22) Filed: Jun. 27, 2025

(51) Int. Cl.
*E21B 43/013* (2006.01)
*E21B 33/035* (2006.01)

(52) U.S. Cl.
CPC ..... *E21B 43/013* (2013.01); *E21B 33/0387* (2020.05)

(58) Field of Classification Search
CPC ..... E21B 43/103; E21B 43/01; E21B 19/00; E21B 41/04; E21B 41/06; E21B 41/08
USPC ..... 166/338
See application file for complete search history.

(56) References Cited

U.S. PATENT DOCUMENTS 8,985,219 B2 * 3/2015 Cruden ..... E21B 33/038 166/341
10,753,182 B2 * 8/2020 Cargol, Jr. ..... E21B 43/0107
12,037,878 B2 * 7/2024 Lundheim ..... F16L 1/26
2004/0226722 A1 * 11/2004 Colyer ..... E21B 33/038 166/360
2008/0286050 A1 * 11/2008 DeLack ..... E21B 43/013 405/172
2010/0038090 A1 * 2/2010 Barratt ..... H02G 1/10 166/341
2013/0321223 A1 * 12/2013 Bokenfohr ..... H01Q 1/04 343/719
2015/0176340 A1 * 6/2015 Bastesen ..... E21B 17/046 166/345
2025/0198260 A1 * 6/2025 Davidsen ..... E21B 47/06
2025/0198261 A1 6/2025 Abdul

* cited by examiner

*Primary Examiner* — Nicole Coy
*Assistant Examiner* — Douglas S Wood
(74) *Attorney, Agent, or Firm* — Kyle R. Miiller

(57) ABSTRACT

Aspects of the present disclosure provide an umbilical termination assembly (UTA). The UTA including a body, an umbilical, and a stab-in member. The body including an umbilical connection and internal circuitry. The umbilical is configured to transmit information and power via electrical signals from a top side to the internal circuitry via the umbilical connection. The stab-in member is coupled to the body. The stab-in member is positionable in a retracted position and an extended position. The stab-in member is rigidly coupled to the body in the retracted position and the stab-in member is pivotably coupled to and protruding from the body in the extended position.

15 Claims, 7 Drawing Sheets

STAB AND HINGE OVER SYSTEM AND METHODS OF USE THEREOF

BACKGROUND

The present disclosure generally relates to the oil and gas industry. More specifically, the present disclosure relates to stab and hinge over (SHO) systems. SHO systems are used to make connections between a top side (e.g., a vessel above a subsea oil and gas system) and subsea components. SHO systems are crucial to the operation of subsea oil and gas operations. As such, there is a continuous need for improved SHO systems.

SUMMARY

Aspects of the present disclosure provide An umbilical termination assembly (UTA). The UTA including a body, an umbilical, and a stab-in member. The body including an umbilical connection and internal circuitry. The umbilical is configured to transmit information and power via electrical signals from a top side to the internal circuitry via the umbilical connection. The stab-in member is coupled to the body. The stab-in member is positionable in a retracted position and an extended position. The stab-in member is rigidly coupled to the body in the retracted position and the stab-in member is pivotably coupled to and protruding from the body in the extended position.

Aspects of the present disclosure provide a stab and hinge over (SHO) system. The SHO system including a guide system, a base structure disposed on a sea floor below a top side and an umbilical termination assembly (UTA). The UTA including a body, an umbilical, a stab-in member, and a retaining mechanism. The body coupled to the guide system, the body including an umbilical connection and internal circuitry. The umbilical is configured to transmit information and power via electrical signals from the top side to the internal circuitry via the umbilical connection. The stab-in member is coupled to the body. The stab-in member is positionable in a retracted position and an extended position. The stab-in member is rigidly coupled to the body in the retracted position and the stab-in member is pivotably coupled to and protruding from the body in the extended position. The retaining mechanism is configured to retain the stab-in member in the retracted position when the retaining mechanism is engaged and configured to allow the stab-in member to be positioned in the extended position when the retaining mechanism is disengaged.

Aspects of the present disclosure provide a method of engaging an umbilical termination assembly (UTA) with a subsea base structure. The method including lowering an umbilical termination assembly (UTA), the UTA including a stab-in member, the stab-in member is positionable in a retracted position and an extended position, wherein the stab-in member is rigidly coupled to a body of the UTA in the retracted position, and wherein a first end of the stab-in member is pivotably coupled to the body by a hinge and a second end of the stab-in member protrudes from the body in the extended position, positioning the stab-in member in the extended position, and guiding the stab-in member into engagement with a receiving receptacle of a subsea base structure.

BRIEF DESCRIPTION OF DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments. It is emphasized that, in accordance with the standard practice in the industry, various features are not drawn to scale. In fact, the dimensions of the various features may be arbitrarily increased or reduced for clarity of discussion.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Illustrative examples of the subject matter claimed below will now be disclosed. In the interest of clarity, not all features of an actual implementation are described in this specification. It will be appreciated which in the development of any such actual implementation, numerous implementation-specific decisions may be made to achieve the developers' specific goals, such as compliance with system-related and business-related constraints, which will vary from one implementation to another. Moreover, it will be appreciated which such a development effort, even if complex and time-consuming, would be a routine undertaking for those of ordinary skill in the art having the benefit of this disclosure.

Further, as used herein, the article "a" is intended to have its ordinary meaning in the patent arts, namely "one or more." Herein, the term "about" when applied to a value generally means within the tolerance range of the equipment used to produce the value, or in some examples, means plus or minus 10%, or plus or minus 5%, or plus or minus 1%, unless otherwise expressly specified. Further, herein the term "substantially" as used herein means a majority, or almost all, or all, or an amount with a range of about 51% to about 100%, for example. Moreover, examples herein are intended to be illustrative only and are presented for discussion purposes and not by way of limitation.

For the sake of brevity, all similar components have been given similar reference numbers with the same last two digits and a full description of such similar components may not be repeated herein. Similarly, for the sake of brevity, all like components have been given the same reference numbers, and a full description of such components may not be repeated herein.

Aspects of the present disclosure provide a stab and hinge over system (SHO) and methods of use thereof. The SHO includes a guide system, a base structure, and an umbilical termination assembly (UTA). The guide system guides the UTA into engagement with the base structure thus making a connection (e.g., a hydraulic or electrical connection) between a top side and the base structure via an umbilical. The UTA includes a body, an umbilical connection coupled the umbilical, internal circuitry coupled to the umbilical connection, and a retractable stab-in member. The retractable stab-in member is positionable in a retracted position and an extended position. In the retracted position, the retractable stab-in member is rigidly coupled to the body and in the extended position, the retractable stab-in member is pivotably coupled to the body and protruding from the body. In the extended position, the retractable stab-in member may be used to guide the UTA into engagement with the base structure.

Figure 1:
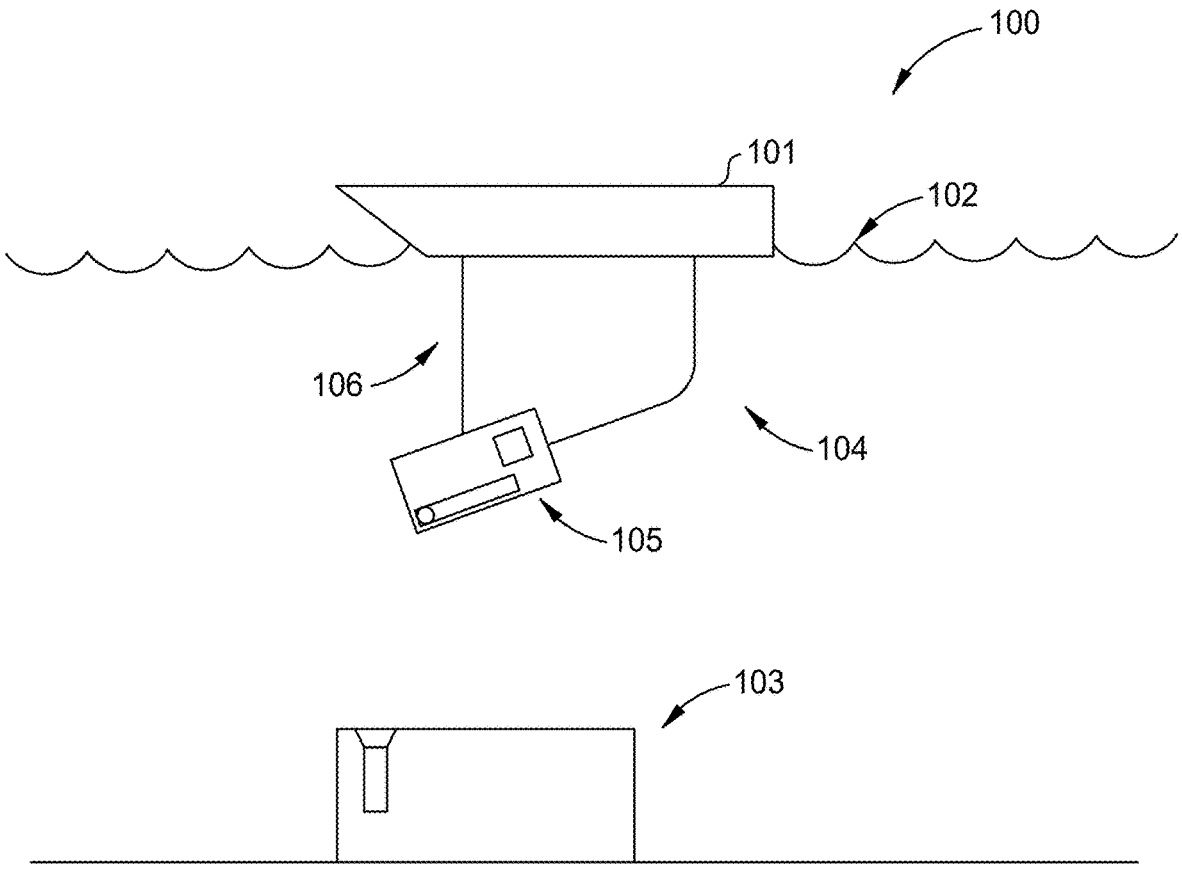
FIG. 1 illustrates a schematic view of an exemplary subsea operation, according to one or more embodiments.

FIG. 1 illustrates an exemplary subsea operation 100. As shown, the subsea operation 100 is a stop and hinge over (SHO) system. The exemplary subsea operation 100 includes a vessel 101 disposed at a top side 102 (e.g., a sea surface). While the vessel 101 is illustrated as a ship, the vessel 101 may include any surface equipment used in the oil and gas industry (i.e., a floating production storage and offloading (FPSO) installation). The vessel 101 may include surface equipment such as control systems configured to conduct subsea oil and gas operations. The vessel 101 is coupleable to a subsea base structure 103 via an umbilical 104. The subsea base structure 103 may be on the seafloor and may include subsea wells, Christmas trees, control modules, or other related subsea equipment for extraction and/or distribution of a liquid and/or gaseous product from under the sea bed. According to one mode of operation, the umbilical 104 may be used for transmitting power, signals, and/or fluids (e.g., hydraulic fluids and chemicals) to the subsea base structure 103.

An umbilical termination assembly (UTA) 105 is used to couple the umbilical 104 to the subsea base structure 103. According to one mode of operation, the UTA 105 is coupled to an end of the umbilical 104 and the UTA 105 is lowered toward the subsea base structure 103. According to one or more embodiments, the UTA 105 is lowered by a guide system 106 (e.g., a cable or crane or other lowering equipment of the vessel 101) and, optionally, is guided by a remote operating vehicle (ROV). Once the UTA 105 reaches the subsea base structure 103, the UTA 105 is guided into engagement with the subsea base structure 103. The umbilical 104 is simultaneously or subsequently coupled to the subsea base structure 103 by the UTA 105, thereby coupling the vessel 101 to the subsea base structure 103 to allow communication between the two for transmitting power, signals, and/or fluids.

Figure 2A:
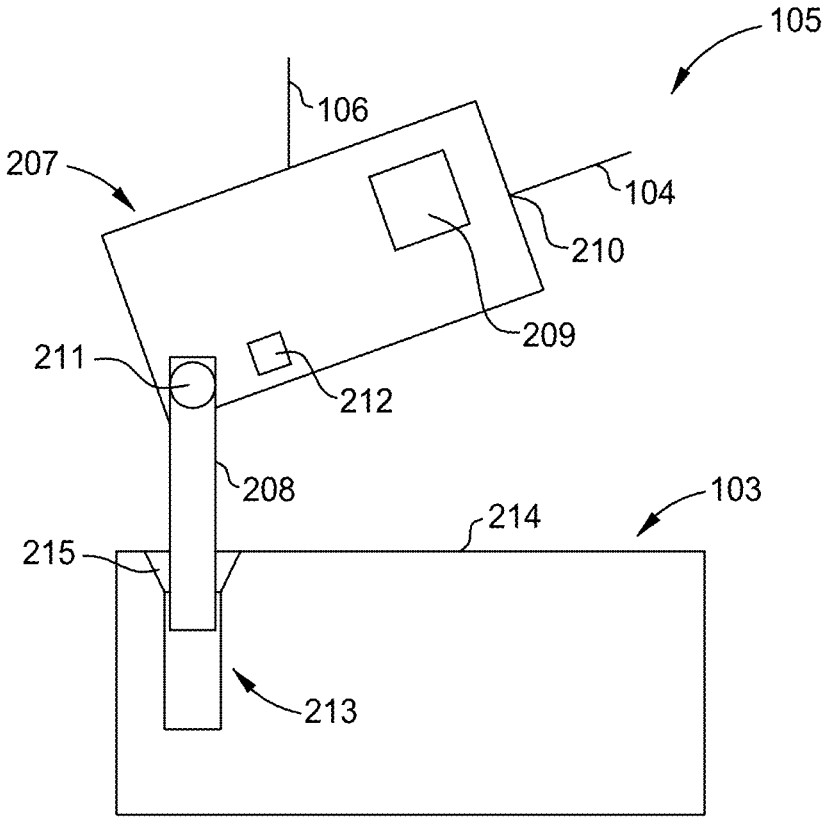
FIG. 2A illustrates a schematic view of an umbilical termination assembly (UTA) being engaged with a subsea base structure, according to one or more embodiments.
Figure 2B:
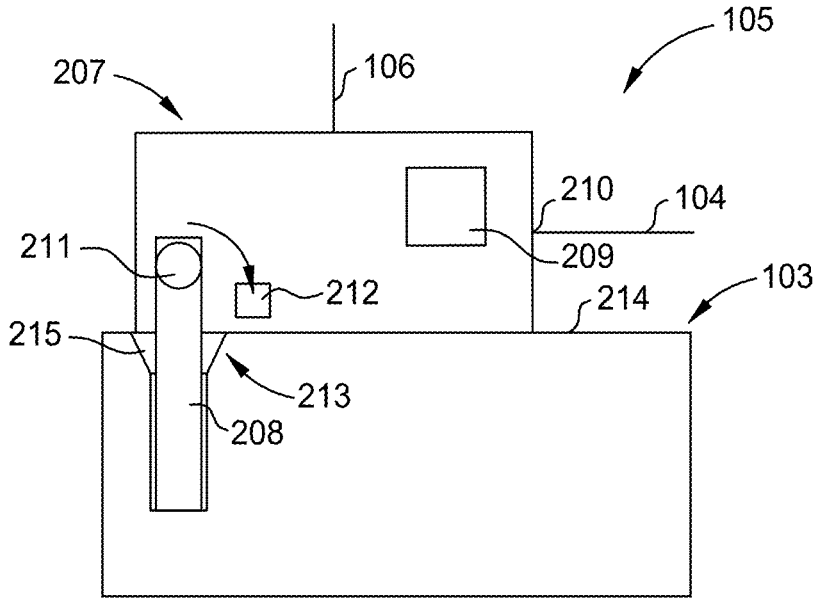
FIG. 2B illustrates a schematic view of the UTA of FIG. 2A engaged with the subsea base structure of FIG. 2A, according to one or more embodiments.

FIGS. 2A-2B illustrate the UTA 105 being guided into engagement with the subsea base structure 103. FIG. 2A illustrates the UTA 105 being engaged with the subsea base structure 103. FIG. 2B illustrates the UTA 105 in engagement with the subsea base structure 103.

The UTA 105 includes a body 207, retractable stab-in member 208, internal circuitry 209, and an umbilical connection 210. The umbilical connection 210 couples the umbilical 104 to the UTA 105. The internal circuitry 209 may include fluid circuitry (hydraulic circuitry or fluid transportation circuitry such as valves, tubes, pumps, etc.) or may include electric circuitry. The internal circuitry 209 includes connection points (not pictured) where the internal circuitry 209 can be coupled to the subsea base structure 103. Accordingly, when the UTA 105 is engaged with the subsea base structure 103 (as shown in FIG. 2B) the umbilical connection 210 transmits power, signals, and/or fluids to and/or from the vessel 101, the power, signals, and/or fluids are routed to the internal circuitry 209 which are then routed to the subsea base structure 103 via the connection points (not pictured). In one or more embodiments, the connection points include cables, lines, and/or hoses and the cables, lines, and/or hoses are connected to the subsea base structure 103 by an ROV after the UTA 105 is engaged with the subsea base structure 103 (as shown in FIG. 2B).

The retractable stab-in member 208 is used to guide the UTA 105 into engagement with the subsea base structure 103. One end of the retractable stab-in member 208 is coupled to the UTA 105 by a hinge 211. Accordingly, the retractable stab-in member 208 is pivotable about the hinge 211 (and that end of the retractable stab-in member 208). According to one or more embodiments, the retractable stab-in member 208 is positionable between a retracted position (not shown), wherein the retractable stab-in member 208 is rigidly coupled to the body and an extended position (illustrated in FIGS. 2A and 2B) wherein the retractable stab-in member 208 is pivotable about the hinge and protruded from the UTA 105 and positioned to guide the UTA 105 into engagement with the subsea base structure 103. In one or more embodiments, in the retracted position, the retractable stab-in member 208 may be retained close to, or inside of, the body 207 thus minimizing the packaging and space taken up by the UTA 105 for purposes of shipment and transportation. The positionability of the retractable stab-in member 208 also allows for the retractable stab-in member 208 to remain connected to the remainder of the UTA 105 during shipment, transportation, and/or any time pre-deployment.

In one or more embodiments, the UTA 105 may include a retaining mechanism 212 configured to retain the retractable stab-in member 208 in the retracted position and configurable to allow the retractable stab-in member 208 into the extended position (as shown). According to one or more embodiments, the retaining mechanism 312 may include a lock, latch, pin, shear pin, or any other mechanism to retain the retractable stab-in member 208 in the retracted position.

The subsea base structure 103 includes a receptacle 213. The receptacle 213 is disposed in a surface 214 of the subsea base structure 103 and is shaped to receive the retractable stab-in member 208. The receptacle 213 may be a hole or a bore which may have a cross-sectional shape of a circle, oval, triangle, square, pentagon, hexagon, octagon, or any other suitable shape so long as the receptacle 213 can receive the retractable stab-in member 208. According to one or more embodiments, the receptacle 213 includes a funnel 215 in the portion of the receptacle 213 nearest to the surface 214 of the base structure 103. The funnel 215 assists in guiding the retractable stab-in member 208 into the receptacle 213.

According to one mode of operation (as shown in FIGS. 2A-2B), the UTA 105 is guided near engagement with the subsea base structure 103, the retractable stab-in member 208 is moved from the retracted position (not shown) to the extended position (as shown in FIGS. 2A-2B), the extended retractable stab-in member 208 is guided towards the receptacle 213 by the funnel 215, the extended retractable stab-in member 208 guides the UTA 105 into further engagement (e.g., by lowering the UTA 105), and as the retractable stab-in member 208 bottoms out in the receptacle 213, the UTA 105 is rotated about the hinge 211 to engage the body 207 of the UTA 105 with the surface 214 of the base structure 103. Simultaneously or subsequently, the internal circuitry 209 is coupled to the subsea base structure 103 (by, for instance, an ROV).

Figure 3A:
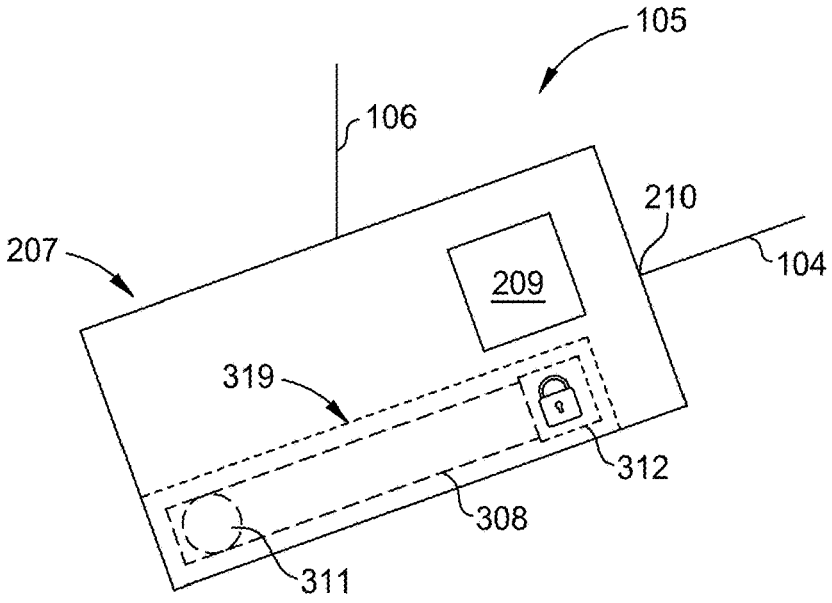
FIG. 3A illustrates a schematic view of an exemplary UTA including a retractable stab-in member in a retracted position, according to one or more embodiments.
Figure 3B:
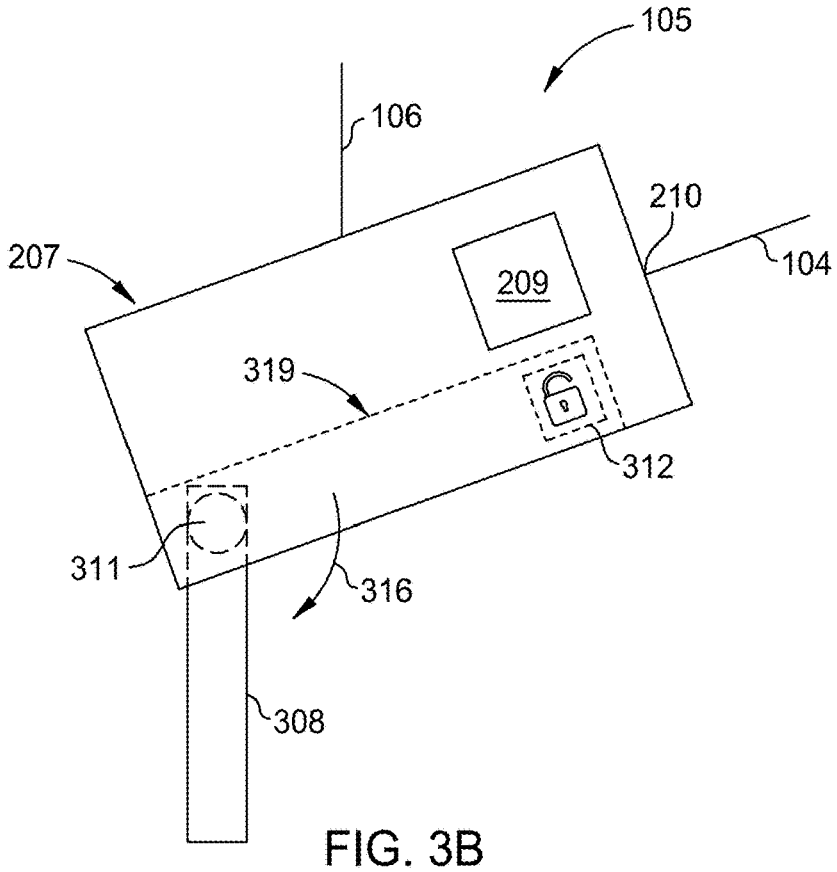
FIG. 3B illustrates a schematic view of the UTA of FIG. 3A with the retractable stab-in member in an intermediate position, according to one or more embodiments.

FIGS. 3A-3B illustrate an exemplary UTA 105 including an exemplary retractable stab-in member 308. FIG. 3A shows the UTA 105 with the retractable stab-in member 308 in the retracted position. FIG. 3B shows the UTA 105 with the retractable stab-in member 308 in the extended position. As previously mentioned, a retaining mechanism 312 retains the retractable stab-in member 308 in the retracted position. In one or more embodiments, the retractable stab-in member 308 may be recessed within the body 207 to minimize overall package size of the UTA 105. For example, as illustrated, the retractable stab-in member 308 is disposed within a recess 319 in the body 207 of the UTA 105. Accordingly, in the retracted position, the retractable stab-in member 308 is completely housed within the recess 319 minimizing total package size of the UTA 105. While illustrated as a recess 319, the retractable stab-in member 308 may be retained in a slot, groove, bore, indentation or other feature of the body 207 such that the overall package size of the UTA 105 is not increased by the addition of the retractable stab-in member 308. In one or more embodiments, the recess 319 includes a casing or a housing (not shown) to protect the retractable stab-in member 308 before it is moved to the extended position.

According to one mode of operation, the retractable stab-in member 308 is in the retracted position and is moved to the extended position before being engaged with a subsea base structure (as shown in FIGS. 2A-2B). In the retracted position (as shown in FIG. 3A), the retractable stab-in member 308 is coupled to the body 207 of the UTA 105 at one end by the hinge 311 (i.e., pivotably coupled) and at another end (e.g., the distal end) is rigidly coupled to the body 207 by the retaining mechanism 312 in an engaged configuration. Moving the retractable stab-in member 308 into the extended position (as shown in FIG. 3B) may include disengaging the retaining mechanism 312 thus allowing the retractable stab-in member 308 to pivot and rotate along arrow 316 about the hinge 311 (and the end of the retractable stab-in member 308 coupled to said hinge 311) into the extended position. While in the extended position, the retractable stab-in member 308 can guide the UTA 105 into engagement with a subsea base structure. In one or more embodiments, the UTA 105 may also include a stop or other mechanism preventing the retractable stab-in member 308 from pivoting past a desired position (e.g., past vertical). In one or more embodiments, gravity allows the retractable stab-in member 308 to settle at vertical thus negating the need for a stop.

Figure 4A:
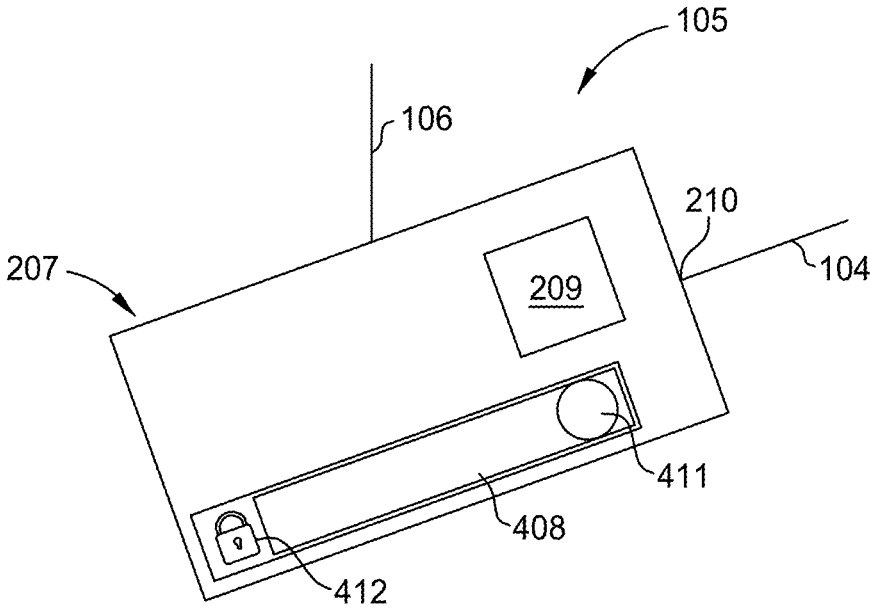
FIG. 4A illustrates a schematic view of another exemplary UTA including a retractable stab-in member in a retracted position, according to one or more embodiments.
Figure 4B:
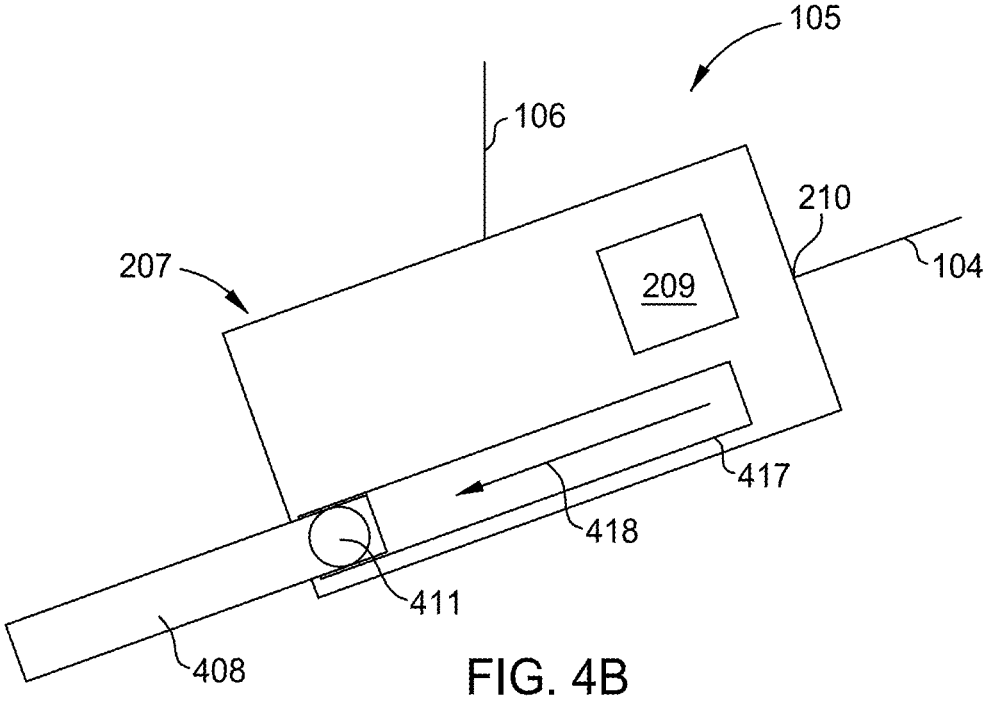
FIG. 4B illustrates a schematic view of the UTA of FIG. 4A with the retractable stab-in member in an intermediate position, according to one or more embodiments.
Figure 4C:
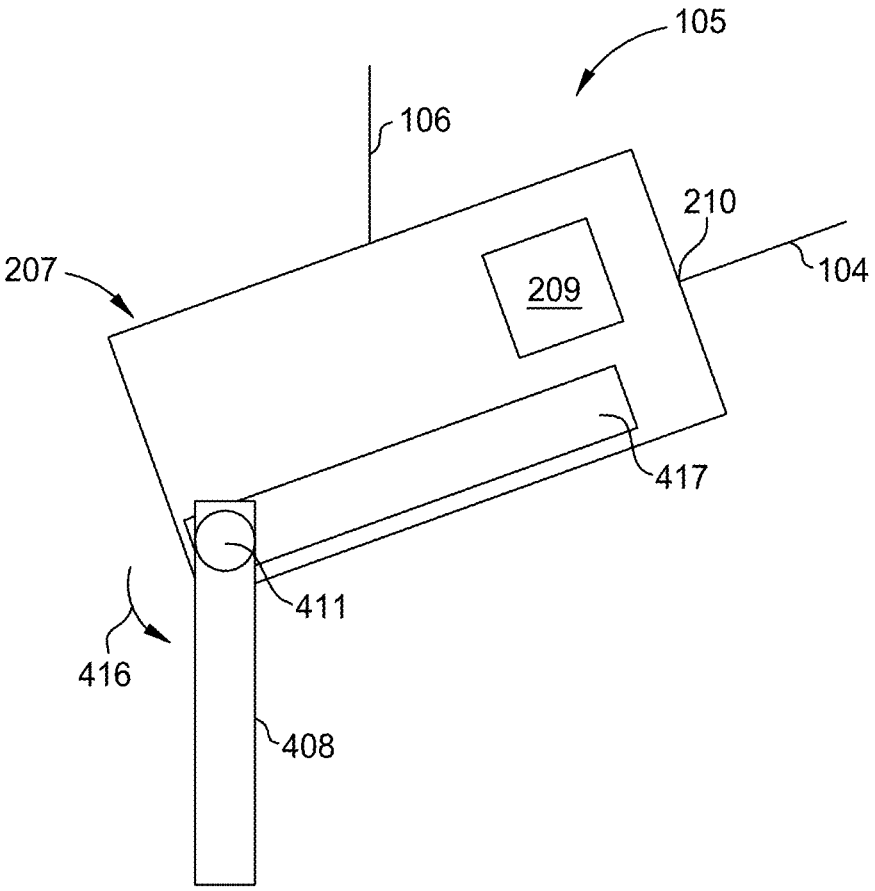
FIG. 4C illustrates a schematic view of the UTA of FIGS. 4A-4B with the retractable stab-in member in an extended position, according to one or more embodiments.

FIGS. 4A-4C illustrate an exemplary UTA 105 including another exemplary retractable stab-in member 408. FIG. 4A shows the UTA 105 with the retractable stab-in member 408 in the retracted position. FIG. 4B shows the UTA 105 with the retractable stab-in member 408 being moved to the extended position (i.e., in an intermediate position). FIG. 4C shows the UTA 105 with the retractable stab-in member 408 in the extended position.

In the illustrated embodiment, the body 207 further includes a guide rail 417 running longitudinally (i.e., axially) along the body 207 (i.e., parallel to a longitudinal/axial axis of the body 207). At least the hinge 411 is disposed in the guide rail 417. In one or more embodiments, such as the one illustrated, the hinge 411 and the retractable stab-in member 408 are disposed in the guide rail 417. The hinge 411 and (if applicable) the retractable stab-in member 408 and are translatable (i.e., slideable) along the guide rail 417. While described as a guide rail 417, the guide rail 417 may include rails, a groove, a slot, or anything that allows translational movement (i.e., sliding) of the hinge 411 and/or the retractable stab-in member 408.

According to one mode of operation, the retractable stab-in member 408 is in the retracted position and is moved to the extended position before being engaged with a subsea base structure (as shown in FIGS. 2A-2B). In the retracted position (as shown in FIG. 4A), the retractable stab-in member 408 is coupled to the body 207 of the UTA 105 at one end by the hinge 411 (i.e., pivotably coupled) and the hinge 411 is disposed in the guide rail 417. The other end (e.g., the distal end) of the retractable stab-in member 408 is disposed in the guide rail 417 and is prevented from rotating about the hinge 411 by the guide rail 417 (i.e., rigidly coupling the retractable stab-in member 408 to the body 207). Further, in the retracted position, the retaining mechanism 412 in an engaged configuration. The retaining mechanism 412 prevents the hinge 411 and/or the retractable stab-in member 408 from translating (i.e., sliding) along the guide rail 417. In the retracted position, the hinge 411 is retained at a first position in the guide rail 417 (e.g., at a first end), as shown in FIG. 4A. While illustrated as being at the end opposite the hinge 411 in the retracted position, the retaining mechanism 412 may be in any position so long as it prevents the hinge 411 and/or the retractable stab-in member 408 from translating (i.e., sliding) along the guide rail 417.

Moving the retractable stab-in member 408 into the extended position (as shown in FIG. 4C) may include disengaging the retaining mechanism 412 thus allowing the hinge 411 and (if applicable) the retractable stab-in member 408 to slide along arrow 418 along the guide rail 417 (as shown in the intermediate position of FIG. 4B). Once the hinge 411 reaches a second position in the guide rail 417 (e.g., the opposite end of the guide rail 417 from where it was), as shown in FIG. 4B, the retractable stab-in member 408 is no longer prevented from rotating about the hinge 411. Accordingly, once the hinge 411 reaches the second position in the guide rail 417, the retractable stab-in member 408 is allowed to pivot along arrow 416 about the hinge 411 (and the end of the retractable stab-in member 408 attached to the hinge 411) into the extended position (as shown in FIG. 4C). While in the extended position, the retractable stab-in member 408 can guide the UTA 105 into engagement with a subsea base structure. In one or more embodiments, the UTA 105 may also include a stop or other mechanism preventing the retractable stab-in member 408 from pivoting past a desired position (e.g., past vertical). In one or more embodiments, gravity allows the retractable stab-in member 408 to settle at vertical thus negating the need for a stop.

Figure 5A:
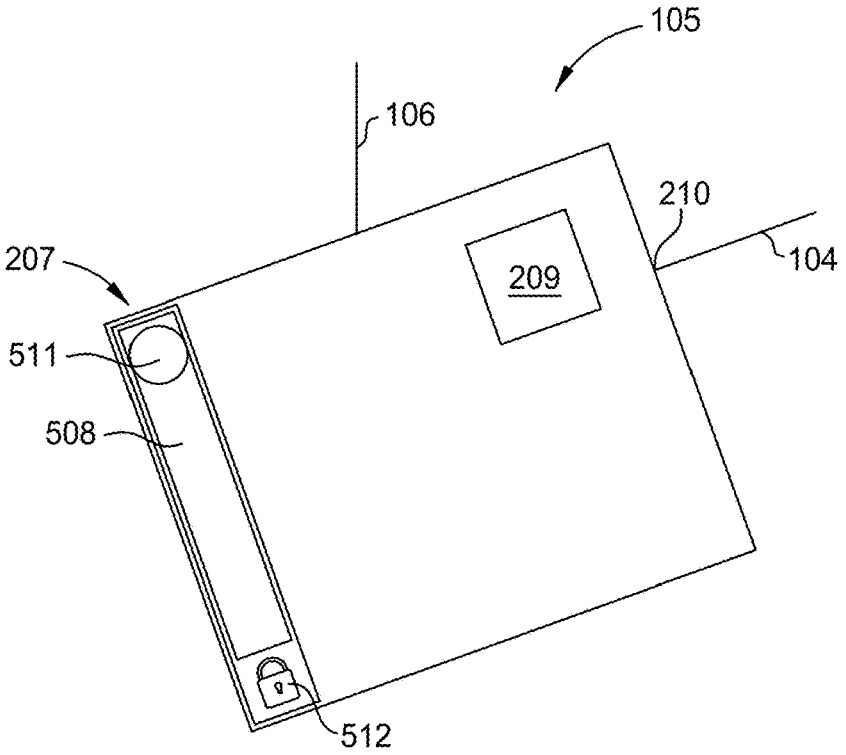
FIG. 5A illustrates a schematic view of another exemplary UTA including a retractable stab-in member in a retracted position, according to one or more embodiments.
Figure 5B:
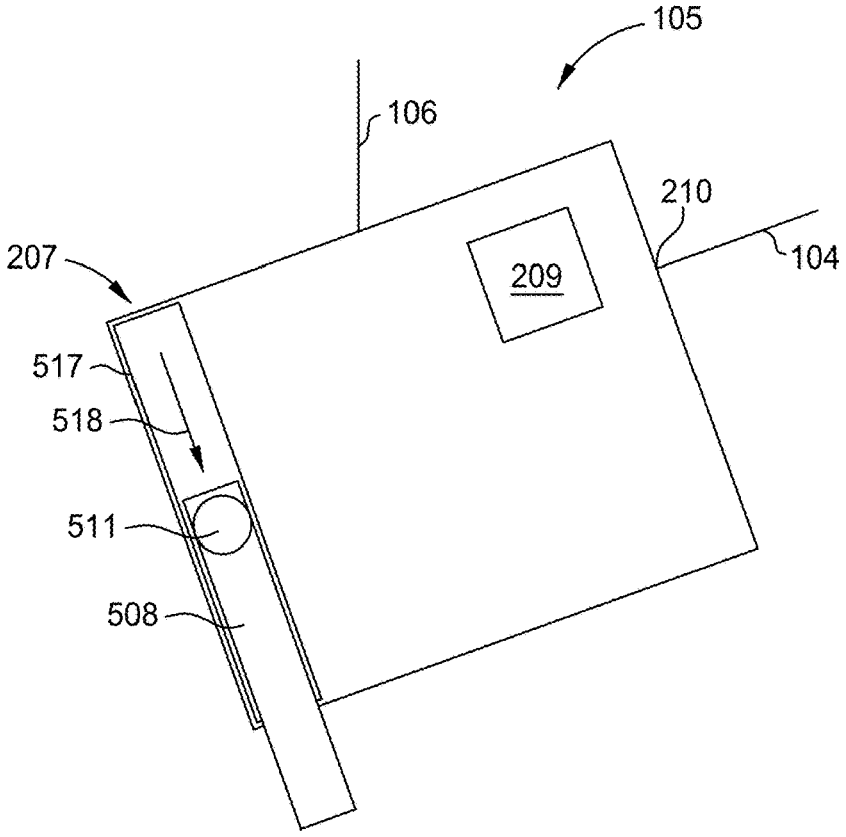
FIG. 5B illustrates a schematic view of the UTA of FIG. 5A with the retractable stab-in member in an intermediate position, according to one or more embodiments.
Figure 5C:
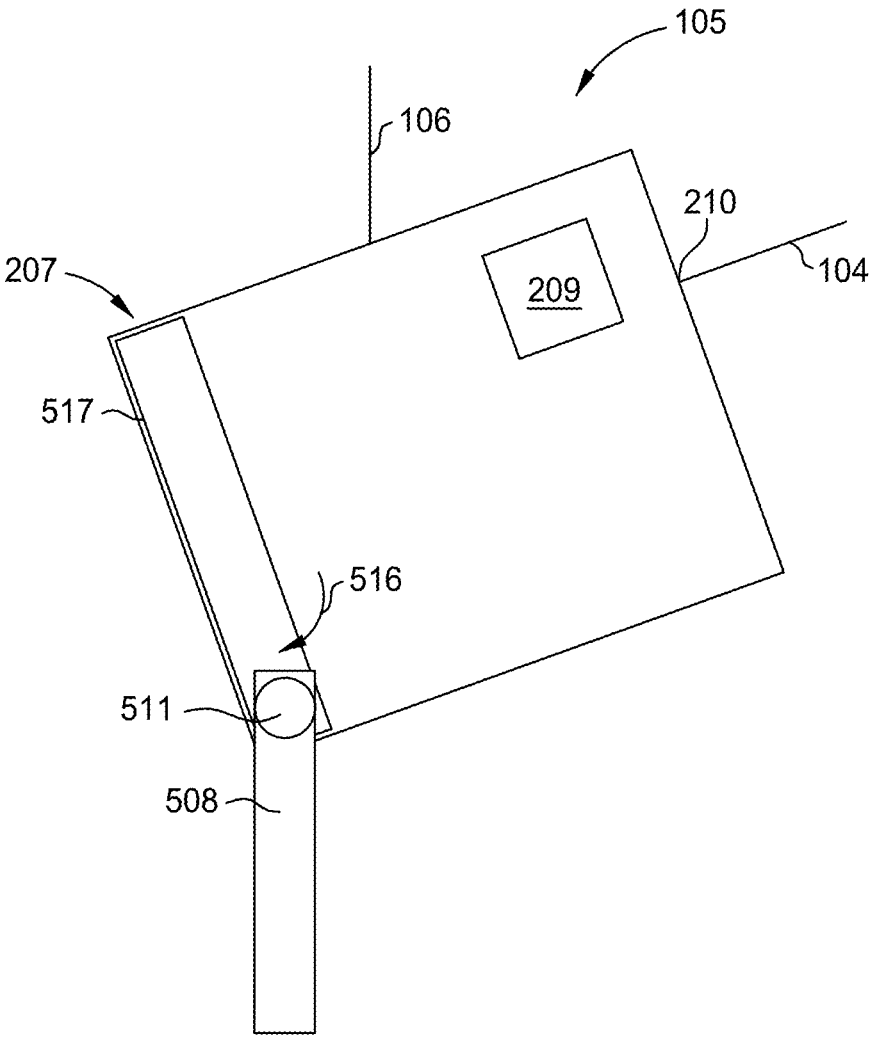
FIG. 5C illustrates a schematic view of the UTA of FIGS. 5A-5B with the retractable stab-in member in an extended position, according to one or more embodiments.

FIGS. 5A-5C illustrate an exemplary UTA 105 including another exemplary retractable stab-in member 508. FIG. 5A shows the UTA 105 with the retractable stab-in member 508 in the retracted position. FIG. 5B shows the UTA 105 with the retractable stab-in member 508 being moved to the extended position (i.e., in an intermediate position). FIG. 5C shows the UTA 105 with the retractable stab-in member 508 in the extended position.

The embodiment illustrated in FIGS. 5A-5C is similar to that illustrated in FIGS. 4A-4C with the exception of the guide rail 517. The guide rail 517 in FIGS. 5A-5C is transverse to the longitudinal axis (i.e., along the lateral axis) of the UTA 105 rather than parallel to the longitudinal (i.e., axial) axis of the UTA 105. That is, the guide rail 517 extends laterally across the body 207. Similar to the embodiment illustrated in FIGS. 4A-4C, the hinge 511 is disposed in the guide rail 517. In one or more embodiments, the hinge 511 and retractable stab-in member 508 are both disposed in the guide rail 517. In one or more embodiments, only the hinge 511 is disposed in the guide rail 517. The hinge 511 and (if applicable) the retractable stab-in member 508 are translatable (i.e., slideable) along the guide rail 517.

According to one mode of operation, the retractable stab-in member 508 is in the retracted position and is moved to the extended position before being engaged with a subsea base structure (as shown in FIGS. 2A-2B). In the retracted position (as shown in FIG. 5A), the retractable stab-in member 508 is coupled to the body 207 of the UTA 105 at one end by the hinge 511 (i.e., pivotably coupled) and the hinge 511 is disposed in the guide rail 517. The other end (e.g., the distal end) of the retractable stab-in member 508 is disposed in the guide rail 517 and is prevented from rotating about the hinge 511 by the guide rail 517 (i.e., rigidly coupling the retractable stab-in member 508 to the body 207). Further, in the retracted position, the retaining mechanism 512 in an engaged configuration. The retaining mechanism 512 prevents the hinge 511 and/or the retractable stab-in member 508 from translating (i.e., sliding) along the guide rail 517. In the retracted position, the hinge 511 is retained at a first position in the guide rail 417 (e.g., at a first end), as shown in FIG. 5A. While illustrated as being at the end opposite the hinge 511 in the retracted position, the retaining mechanism 512 may be in any position so long as it prevents the hinge 511 and/or the retractable stab-in member 508 from translating (i.e., sliding) along the guide rail 517.

Moving the retractable stab-in member 508 into the extended position (as shown in FIG. 5C) may include disengaging the retaining mechanism 512 thus allowing the hinge 511 and (if applicable) the retractable stab-in member 508 to slide along arrow 518 along the guide rail 517 (as shown in the intermediate position of FIG. 5B). Once the hinge 511 reaches a second position in the guide rail 517 (e.g., the opposite end of the guide rail 417 from where it was), as shown in FIG. 5B, the retractable stab-in member 508 is no longer prevented from rotating about the hinge 511. Accordingly, once the hinge 411 reaches the second position in the guide rail 517, the retractable stab-in member 508 is allowed to pivot along arrow 516 about the hinge 511 (and the end of the retractable stab-in member 508 attached to the hinge 511) into the extended position (as shown in FIG. 5C). While in the extended position, the retractable stab-in member 508 can guide the UTA 105 into engagement with a subsea base structure. In one or more embodiments, the UTA 105 may also include a stop or other mechanism preventing the retractable stab-in member 508 from pivoting past a desired position (e.g., past vertical). In one or more embodiments, gravity allows the retractable stab-in member 508 to settle at vertical thus negating the need for a stop.

Figure 6:
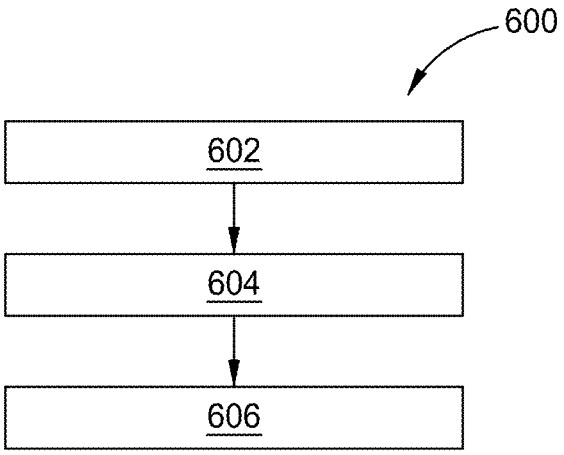
FIG. 6 illustrates a method for engaging a UTA with a subsea base structure, according to one or more embodiments.

FIG. 6 illustrates a method 600 for engaging a UTA (such as UTA 105, with a subsea base structure (such as subsea base structure 103).

At operation 602, the UTA is lowered towards the subsea base structure. The UTA includes a body (such as body 207), a retractable stab-in member (such as retractable stab-in members 208, 308, 408, and 508), internal circuitry (such as internal circuitry 209), and an umbilical connection (such as umbilical connection 210) connecting an umbilical (such as umbilical 104) to the internal circuitry. In one or more embodiments, the UTA further includes a retaining mechanism (such as retaining mechanisms 212, 312, 412, and 512). The UTA may further include any components mentioned above in the descriptions of FIGS. 1-5C.

At operation 604, the retractable stab-in member is positioned from a retracted position to an extended position. In the retracted position, the stab-in member is rigidly coupled to the body of the UTA. In the extended position, a first end of the stab-in member is pivotably coupled to the body by a hinge and a second end of the stab-in member protrudes from the body. In one or more embodiments, when the retractable stab-in member is in the retracted position, the retaining mechanism retains the retractable stab-in member in the retracted position. Accordingly, in one or more embodiments, the method 600 further includes disengaging the retaining mechanism to allow the retractable stab-in member to be positioned in the extended position.

In one or more embodiments, disengaging the retaining mechanism allows the retractable stab-in member to pivot (i.e., the second end of the retractable stab-in member is able to pivot) about the hinge (i.e., about the first end of the retractable stab-in member). Accordingly, positioning the retractable stab-in member in the extended position may include disengaging the retaining mechanism and pivoting the second end of the stab-in member about the first end.

In one or more embodiments, the UTA includes a guide rail (such as guide rails 417, 517) in which the hinge (and, in some embodiments, the retractable stab-in member), resides. In some embodiments, the guide rail extends axially (i.e., longitudinally) along the body of the UTA. In some embodiments, the guide rail extends laterally across the body (i.e., transverse to an axial/longitudinal axis of the body). In one or more embodiments including the guide rail, positioning the stab-in member in the extended position includes sliding the hinge from a first position in the guide rail to a second position. In the first position, the end of the retractable stab-in member opposite the hinged end is retained in the guide rail. In the second position, the second end of the retractable stab-in member is pivotable about the hinge.

At operation 606, the stab-in member (in the extended position) is guided into engagement with a receiving receptacle (such as receptacle 213) disposed in a surface (such as surface 214) of the subsea base structure. In one or more embodiments, a funnel (such as funnel 215) assists in guiding the retractable stab-in member into the receptacle. In one or more embodiments, after the retractable stab-in member is guided into engagement with the receptacle (e.g., the retractable stab-in member bottoms out in the receptacle), the body pivots about the hinge so that the body engages with the surface of the subsea base structure. Still, in one or more embodiments, after the retractable stab-in member is guided into engagement with the receptacle (whether or not the body is engaged with the surface of the subsea base structure), the internal circuitry is communicatively coupled to the subsea base structure. Thus, the UTA may be used to make an umbilical connection between the top side, or a vessel or equipment at the top side, and the subsea base structure via the umbilical to transmit power, signals, and/or fluids.

EXAMPLE ASPECTS

Aspect 1: Aspects of the present disclosure provide an umbilical termination assembly (UTA). The UTA including a body, an umbilical, and a stab-in member. The body including an umbilical connection and internal circuitry. The umbilical is configured to transmit information and power via electrical signals from a top side to the internal circuitry via the umbilical connection. The stab-in member is coupled to the body. The stab-in member is positionable in a retracted position and an extended position. The stab-in member is rigidly coupled to the body in the retracted position and the stab-in member is pivotably coupled to and protruding from the body in the extended position.

Aspect 2: The UTA of Aspect 1, further including a retaining mechanism configured to retain the stab-in member in the retracted position when the retaining mechanism is engaged and is configured to allow the stab-in member to be positioned in the extended position when the retaining mechanism is disengaged.

Aspect 3: The UTA of Aspect 2, wherein a hinge couples a first end of the stab-in member to the body, and wherein the retaining mechanism couples a second end of the stab-in member to the body when the stab-in member is in the retracted position and the retaining mechanism is engaged.

Aspect 4: The UTA of Aspect 3, wherein when the retaining mechanism is disengaged, the second end of the stab-in member is uncoupled from the body and the stab-in member is pivotable about the first end.

Aspect 5: The UTA of Aspect 1, further including a guide rail, wherein a hinge couples a first end of the stab-in member to the body, the hinge is slidably disposed in the guide rail, and the hinge is positioned at a first position within the guide rail and a second end of the stab-in member is slidably disposed in the guide rail when the stab-in member is in the retracted position.

Aspect 6: The UTA of Aspect 5, wherein the guide rail extends axially along the body.

Aspect 7: The UTA of Aspect 5, wherein the guide rail extends laterally across the body.

Aspect 8: The UTA of any of Aspects 5-7, wherein in the extended position, the hinge is positioned at a second position within the guide rail such that the second end of the stab-in member is pivotable about the first end Aspect 9: Aspects of the present disclosure provide a stab and hinge over (SHO) system. The SHO system including a guide system, a base structure disposed on a sea floor below a top side and an umbilical termination assembly (UTA). The UTA including a body, an umbilical, a stab-in member, and a retaining mechanism. The body coupled to the guide system, the body including an umbilical connection and internal circuitry. The umbilical is configured to transmit information and power via electrical signals from the top side to the internal circuitry via the umbilical connection. The stab-in member is coupled to the body. The stab-in member is positionable in a retracted position and an extended position. The stab-in member is rigidly coupled to the body in the retracted position and the stab-in member is pivotably coupled to and protruding from the body in the extended position. The retaining mechanism is configured to retain the stab-in member in the retracted position when the retaining mechanism is engaged and configured to allow the stab-in member to be positioned in the extended position when the retaining mechanism is disengaged.

Aspect 10: The SHO system of Aspect 9, wherein a hinge couples a first end of the stab-in member to the body, and wherein the retaining mechanism couples a second end of the stab-in member to the body when the stab-in member is in the retracted position and the retaining mechanism is engaged.

Aspect 11: The SHO system of Aspect 10, wherein when the retaining mechanism is disengaged, the second end of the stab-in member is uncoupled from the body and the stab-in member is pivotable about the first end.

Aspect 12: The SHO system of Aspect 9, further including a guide rail, wherein a hinge couples a first end of the stab-in member to the body, the hinge is slidably disposed in the guide rail, and the hinge is positioned at a first position within the guide rail and a second end of the stab-in member is slidably disposed in the guide rail when the stab-in member is in the retracted position.

Aspect 13: The SHO system of Aspect 12, wherein the guide rail extends axially along the body.

Aspect 14: The SHO system of Aspect 12, wherein the guide rail extends laterally across the body.

Aspect 15: The SHO system of any of Aspects 12-14, wherein in the extended position, the hinge is positioned at a second position within the guide rail such that the second end of the stab-in member is pivotable about the first end.

Aspect 16: Aspects of the present disclosure provide a method of engaging an umbilical termination assembly (UTA) with a subsea base structure. The method including lowering an umbilical termination assembly (UTA), the UTA including a stab-in member, the stab-in member is positionable in a retracted position and an extended position, wherein the stab-in member is rigidly coupled to a body of the UTA in the retracted position, and wherein a first end of the stab-in member is pivotably coupled to the body by a hinge and a second end of the stab-in member protrudes from the body in the extended position, positioning the stab-in member in the extended position, and guiding the stab-in member into engagement with a receiving receptacle of a subsea base structure.

Aspect 17: The method of Aspect 16, further including disengaging a retaining mechanism of the UTA, wherein disengaging the retaining mechanism allows the stab-in member to be positioned in the extended position.

Aspect 18: The method of Aspect 17, wherein positioning the stab-in member in the extended position includes disengaging the retaining mechanism and pivoting the second end of the stab-in member about the first end.

Aspect 19: The method of any of Aspects 16-17, wherein positioning the stab-in member in the extended position includes sliding the hinge from a first position in a guide rail of the UTA to a second position in the guide rail, wherein, in the first position, the second end of the stab-in member is retained in the guide rail and, in the second position, the stab-in member is pivotable about the hinge.

Aspect 20: The method of Aspect 19, wherein the guide rail extends axially along a body of the UTA.

Aspect 21: The method of Aspect 19, wherein the guide rail extends laterally across a body of the UTA.

Any one or more components of the UTA 105 or subsea operation 100 may be integrally formed together, directly coupled together, and/or indirectly coupled together and are not limited to the specific arrangement of components illustrated in FIGS. 1-5B. Any one or more of the embodiments of the UTA 105 or subsea operation 100 may be combined in whole or part with any one or more of the embodiments of the UTA 105 or subsea operation 100.

The methods disclosed herein comprise one or more actions for achieving the methods. The method actions may be interchanged with one another without departing from the scope of the claims. In other words, unless a specific order of actions is specified, the order and/or use of specific actions may be modified without departing from the scope of the claims. Further, the various operations of methods described above may be performed by any suitable means capable of performing the corresponding functions.

While the present disclosure has been described with respect to a number of embodiments and examples, those skilled in the art, having benefit of this disclosure, will appreciate that other embodiments can be devised which do not depart from the scope and spirit of the present disclosure.

The preceding description, for purposes of explanation, uses specific nomenclature to provide a thorough understanding of the disclosure and is provided to enable any person skilled in the art to practice the various aspects described herein. However, it will be apparent to one skilled in the art which the specific details are not required in order to practice the systems and methods described herein. The examples discussed herein are not limiting of the scope, applicability, or aspects set forth in the claims. They are not intended to be exhaustive of or to limit this disclosure to the precise forms described. Various modifications to these aspects will be readily apparent to those skilled in the art, and the general principles defined herein may be applied to other aspects. For example, changes may be made in the function and arrangement of elements discussed without departing from the scope of the disclosure. Various examples may omit, substitute, or add various procedures or components as appropriate. The examples are shown and described in order to best explain the principles of this disclosure and practical applications, to thereby enable others skilled in the art to best utilize this disclosure and various examples with various modifications as are suited to the particular use contemplated. For instance, the methods described may be performed in an order different from that described, and various actions may be added, omitted, or combined. Also, features described with respect to some examples may be combined in some other examples. For example, an apparatus may be implemented or a method may be practiced using any number of the aspects set forth herein. In addition, the scope of the disclosure is intended to cover such an apparatus or method that is practiced using other structure, functionality, or structure and functionality in addition to, or other than, the various aspects of the disclosure set forth herein. It should be understood that any aspect of the disclosure disclosed herein may be embodied by one or more elements of a claim. It is intended which the scope of this disclosure be defined by the claims and their equivalents below.

What is claimed is:

1. An umbilical termination assembly (UTA), comprising:

a body, the body including an umbilical connection and internal circuitry;

an umbilical configured to transmit information and power via electrical signals from a top side to the internal circuitry via the umbilical connection; and a stab-in member, wherein the stab-in member is coupled to the body, the stab-in member is positionable in a retracted position and an extended position, wherein the stab-in member is rigidly coupled to the body in the retracted position, and wherein the stab-in member is pivotably coupled to and protruding from the body in the extended position; and a guide rail, wherein a hinge couples a first end of the stab-in member to the body, wherein the hinge is slidably disposed in the guide rail, and wherein the hinge is positioned at a first position within the guide rail and a second end of the stab-in member is slidably disposed in the guide rail when the stab-in member is in the retracted position.

2. The UTA of claim 1, further comprising a retaining mechanism configured to retain the stab-in member in the retracted position when the retaining mechanism is engaged and is configured to allow the stab-in member to be positioned in the extended position when the retaining mechanism is disengaged.

3. The UTA of claim 2, wherein when the retaining mechanism is disengaged, the stab-in member is pivotable about the first end.

4. The UTA of claim 1, wherein the guide rail extends axially along the body.

5. The UTA of claim 1, wherein the guide rail extends laterally across the body.

6. The UTA of claim 1, wherein in the extended position, the hinge is positioned at a second position within the guide rail such that the second end of the stab-in member is pivotable about the first end.

7. A stab and hinge over (SHO) system, including:

a guide system;

a base structure disposed on a sea floor below a top side; and an umbilical termination assembly (UTA), the UTA comprising:

a body coupled to the guide system, the body including an umbilical connection and internal circuitry;

an umbilical configured to transmit information and power via electrical signals from the top side to the internal circuitry via the umbilical connection;

a stab-in member, wherein the stab-in member is coupled to the body, the stab-in member is positionable in a retracted position and an extended position, wherein the stab-in member is rigidly coupled to the body in the retracted position, and wherein the stab-in member is pivotably coupled to and protruding from the body in the extended position;

a retaining mechanism configured to retain the stab-in member in the retracted position when the retaining mechanism is engaged and configured to allow the stab-in member to be positioned in the extended position when the retaining mechanism is disengaged; and a guide rail, wherein a hinge couples a first end of the stab-in member to the body, wherein the hinge is slidably disposed in the guide rail, and wherein the hinge is positioned at a first position within the guide rail and a second end of the stab-in member is slidably disposed in the guide rail when the stab-in member is in the retracted position.

8. The SHO system of claim 7, wherein when the retaining mechanism is disengaged, the stab-in member is pivotable about the first end.

9. The SHO system of claim 7, wherein the guide rail extends axially along the body.

10. The SHO system of claim 7, wherein the guide rail extends laterally across the body.

11. The SHO system of claim 7, wherein in the extended position, the hinge is positioned at a second position within the guide rail such that the second end of the stab-in member is pivotable about the first end.

12. A method of engaging an umbilical termination assembly (UTA) with a subsea base structure, comprising:

lowering the UTA, the UTA including a stab-in member, wherein the stab-in member is positionable in a retracted position and an extended position, wherein the stab-in member is rigidly coupled to a body of the UTA in the retracted position, and wherein a first end of the stab-in member is pivotably coupled to the body by a hinge and a second end of the stab-in member protrudes from the body in the extended position;

positioning the stab-in member in the extended position, wherein positioning the stab-in member in the extended position includes sliding the hinge from a first position in a guide rail of the UTA to a second position in the guide rail, and wherein, in the first position, the second end of the stab-in member is retained in the guide rail and, in the second position, the stab-in member is pivotable about the hinge; and guiding the stab-in member into engagement with a receiving receptacle of the subsea base structure.

13. The method of claim 12, further comprising disengaging a retaining mechanism of the UTA, wherein disengaging the retaining mechanism allows the stab-in member to be positioned in the extended position.

14. The method of claim 13, wherein positioning the stab-in member in the extended position includes disengaging the retaining mechanism and pivoting the second end of the stab-in member about the first end.

15. The method of claim 12, wherein the guide rail extends:

(i) axially along body of the UTA; or (ii) laterally across the body of the UTA.

* * * * *